US010315894B2

(12) United States Patent
Anderson

(10) Patent No.: US 10,315,894 B2
(45) Date of Patent: Jun. 11, 2019

(54) WINCH FAIRLEAD GUIDE

(71) Applicant: Cameron Anderson, Greenwood (CA)

(72) Inventor: Cameron Anderson, Greenwood (CA)

( * ) Notice: Subject to any disclaimer, the term of this patent is extended or adjusted under 35 U.S.C. 154(b) by 107 days.

(21) Appl. No.: 15/419,865

(22) Filed: Jan. 30, 2017

(65) Prior Publication Data

US 2018/0215591 A1 Aug. 2, 2018

(51) Int. Cl.
*B66D 1/36* (2006.01)
*B66D 1/38* (2006.01)

(52) U.S. Cl.
CPC ..... *B66D 1/38* (2013.01)

(58) Field of Classification Search
CPC ..... B66D 1/38; B66D 2700/0191; B65H 54/2827; A01K 89/01912
See application file for complete search history.

(56) References Cited

U.S. PATENT DOCUMENTS 2,344,417 A * 3/1944 Schmidt ..... B66D 1/36 254/326
2,738,938 A 3/1956 Benson et al.
3,255,982 A * 6/1966 Emry ..... A01K 89/01556 242/228
3,994,477 A 11/1976 Bexten
4,015,798 A * 4/1977 Benya ..... B66D 1/38 242/157.1
4,778,121 A * 10/1988 Minnee ..... B66D 1/38 242/157.1
4,991,323 A * 2/1991 Benkler ..... B66D 1/00 172/816
5,330,122 A * 7/1994 Wood ..... B65H 54/2821 242/397.3
5,388,781 A * 2/1995 Sauber ..... B65H 54/02 242/365.6
5,392,936 A * 2/1995 Solomon ..... B66C 23/44 212/258
7,111,803 B2 6/2006 Mott
7,380,742 B2 * 6/2008 Stevens ..... B60D 1/185 242/157.1
8,267,379 B2 9/2012 Yang et al.
8,602,394 B2 12/2013 Christiansen
9,248,999 B2 2/2016 Xydias
9,440,825 B2 9/2016 Xydias
2001/0042808 A1 * 11/2001 Klaus ..... B65H 54/2827 242/483.8

(Continued)

FOREIGN PATENT DOCUMENTS

CN 103964331 8/2014
DE 2419406 11/1975
EP 2980003 3/2016

*Primary Examiner* — Emmanuel M Marcelo
(74) *Attorney, Agent, or Firm* — Richard D. Okimaw

(57) ABSTRACT

An apparatus for guiding a flexible elongate tension member onto a spool comprises a pivot located in front of the spool extending along a vertical axis and a head extending between proximate and distal ends wherein the proximate end is rotatably supported by the pivot along the vertical axis. The apparatus further includes a fairlead located in the distal end of the head, the fairlead defining an opening for passing the flexible elongate tension member therethrough, the opening extending along a plane which is parallel to and spaced apart from the vertical axis.

14 Claims, 6 Drawing Sheets

(56) References Cited

U.S. PATENT DOCUMENTS

| | | | | |
|---|---|---|---|---|
| 2002/0021851 | A1* | 2/2002 | Trimborn | B65H 54/2827 384/317 |
| 2004/0021031 | A1* | 2/2004 | Klaus | B65H 54/2827 242/483.8 |
| 2005/0072347 | A1* | 4/2005 | Niebur | B63B 21/10 114/293 |
| 2005/0230671 | A1* | 10/2005 | Mott | B66D 1/38 254/385 |
| 2006/0237565 | A1* | 10/2006 | Barker | A01K 89/0114 242/229 |
| 2015/0076266 | A1* | 3/2015 | Crawford | B66D 1/38 242/156.1 |
| 2016/0016766 | A1 | 1/2016 | Ho | |

* cited by examiner

WINCH FAIRLEAD GUIDE

BACKGROUND OF THE INVENTION

1. Field of Invention

The present invention relates generally to cable winches, and specifically to the fairlead guide through which the cable passes when winding the cable onto the winch drum.

2. Description of Related Art

Wire cables are used in many industries to apply tension to and move objects with the aid of a winch. The cable is wound onto a drum driven by a motor. The cable is fed through a fairlead guide, which aids to guide the cable onto the spooling drum, preventing damage to the cable. The cable may be wound onto the drum either with or without an object attached to the end.

To ensure that the cable winds evenly onto the drum when there is little tension on the cable during the winching operation, typically an operator holds the cable in his hand, providing manual tension to the cable between his hand and the drum, while also pivoting or moving his hand so as to direct the cable back and forth across the drum, which prevents binding and helps to ensure an even layout of cable on the drum. Disadvantageously, this method of winding the cable requires the operator to manually handle the moving cable through his hand, which increases the potential for operator injury. Additionally, the level of tension provided by the operator may be inconsistent and therefore result in an uneven spool, increasing the likelihood of damage to the cable.

Previous attempts have been made to provide a means for tensioning the cable while it is being wound onto the spool. Such devices have commonly included a clamp or other way of providing tension to the cable. Disadvantageously, such devices only clamp the cable and do not provide any means to guide the location of the cable around the spool which may result in an uneven distribution therealong. Examples of such devices may be found, for example in U.S. Pat. No. 9,440,825 to Xydias or US Patent Application Publication No. 2016/0016766 to Ho.

SUMMARY OF THE INVENTION

According to a first embodiment of the present invention there is disclosed an apparatus for guiding a flexible elongate tension member onto a spool, the apparatus comprising a pivot located in front of the spool extending along a vertical axis and a head extending between proximate and distal ends wherein the proximate end is rotatably supported by the pivot along the vertical axis. The apparatus further includes a fairlead located in the distal end of the head, the fairlead defining an opening for passing the flexible elongate tension member therethrough, the opening extending along a plane which is parallel to and spaced apart from the vertical axis.

The plane of the opening may extend along a tangent of a radius defined by rotating the head about the vertical axis. The fairlead may include top and bottom rollers and first and second side rollers defining the opening therebetween. The bottom roller may be supported within slots in the head so as to be vertically translatable therein. The apparatus may further comprise at least one biasing spring adapted to selectably bias the bottom roller to a topmost position within the slots. The at least one biasing spring may comprise one biasing spring. The one biasing spring may extend between first and second ends of the bottom roller so as to be extendable over the head so as to bias the bottom roller to the topmost position within the slots. The at least one biasing spring may comprise two biasing springs. The two biasing springs may extend from first and second ends of the bottom roller so as to be extendable to and engageable with the head so as to bias the bottom roller to the topmost position within the slots.

The apparatus may further comprise a rear bracket supporting the pivot thereon. The rear bracket may be secured to the winch. The rear bracket further includes first and second end stops extending therefrom positioned to engage upon the head at corresponding first and second side ends of rotation about the vertical axis.

The head may further include a handle extending therefrom for a user to rotate the head about the vertical axis. The handle may comprise a bar extending substantially parallel from the head.

According to a further embodiment of the present invention there is disclosed a winch comprising a spool extending along a horizontal axis adapted to wind an elongate flexible tension member therearound and a pivot located in front of the spool extending along a vertical axis. The winch further includes a head extending between proximate and distal ends wherein the proximate end is rotatably supported by the pivot along the vertical axis and a fairlead located in the distal end of the head, the fairlead defining an opening for passing the flexible elongate tension member therethrough, the opening extending along a plane which is parallel to and spaced apart from the axis.

According to a further embodiment of the present invention there is disclosed a method for winding a flexible elongate tension member about a spool of a winch. The method comprises providing a pivot in front of the spool extending along a vertical axis and pivotally supporting a head extending between proximate and distal ends from the pivot, wherein the proximate end is rotatably supported by the pivot along the vertical axis. The method further comprises passing the flexible elongate tension member through a fairlead located in the distal end of the head, the fairlead defining an opening for passing the flexible elongate tension member therethrough, the opening extending along a plane which is parallel to and spaced apart from the axis and moving the head side to side while rotating the spool so as to adjust the position of the flexible elongate tension member upon the spool.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
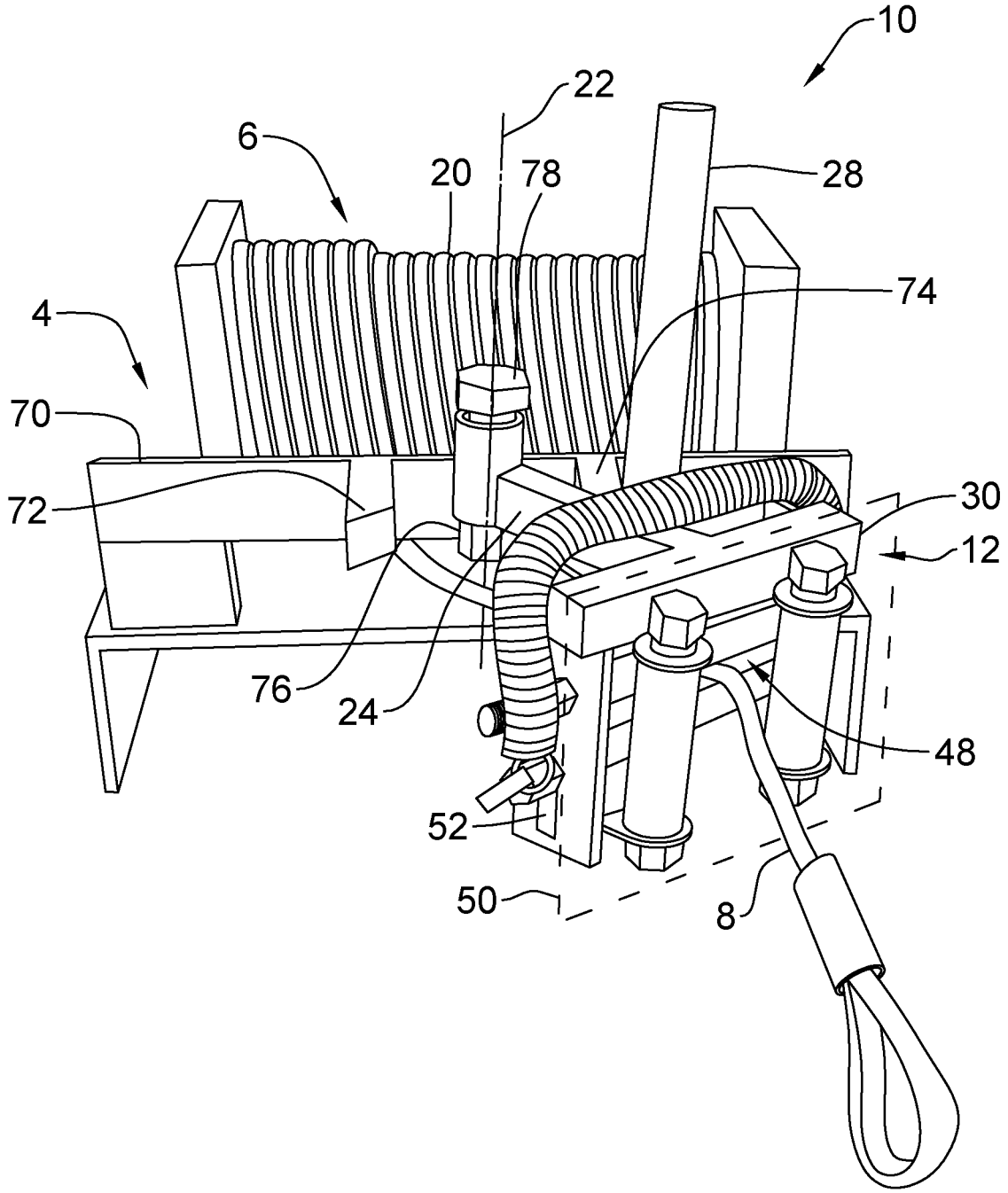
FIG. 1 is a perspective view of an apparatus for guiding a flexible elongate member onto a spool, according to a first embodiment of the present invention, with a cable passing therethrough.

Referring to FIG. 1, an apparatus for guiding a flexible elongate tension member 8 or cable onto a horizontal spool 6 according to a first embodiment of the invention is shown generally at 10. The apparatus 10 comprises a head 12 including a fairlead 30 which is pivotably supported by a bracket 70 proximate to the spool 6. The flexible elongate tension member 8 passes through the fairlead 8 to the spool 6, as will be set out further below.

Figure 4:
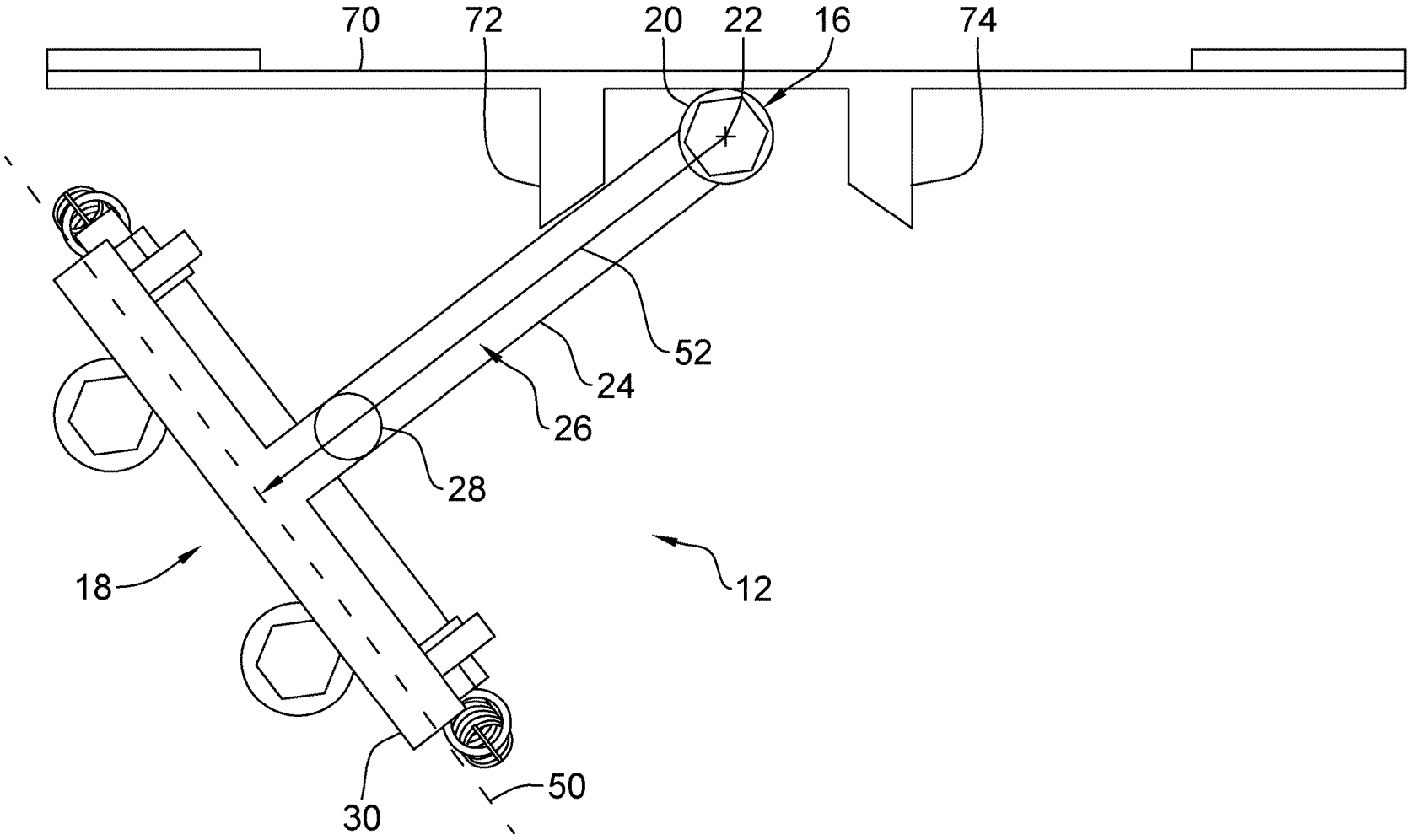
FIG. 4 is a top view of the apparatus of FIG. 1 in a pivoted position.

Referring to FIG. 4, the head 12 extends between proximate and distal ends, 16 and 18, respectively, with a pivot tube 20 having a vertical pivot axis 22 at the proximate end 16 and a fairlead 30 at the distal end 18. A rigid elongate member 24, having a top surface 26, extends horizontally between the pivot 20 and the fairlead 30, with a handle 28 extending vertically therefrom the top surface 26 proximate to the fairlead 30. As best seen in FIG. 1, the handle 28 comprises a rigid bar extending substantially parallel to the pivot axis 22 therefrom the head 12. As will be set out further below, the handle 28 may be used to rotate the head 12 about the pivot axis 22 so as to guide the flexible elongate tension member 8 to different locations along the spool 6 as desired by a user.

Figure 2:
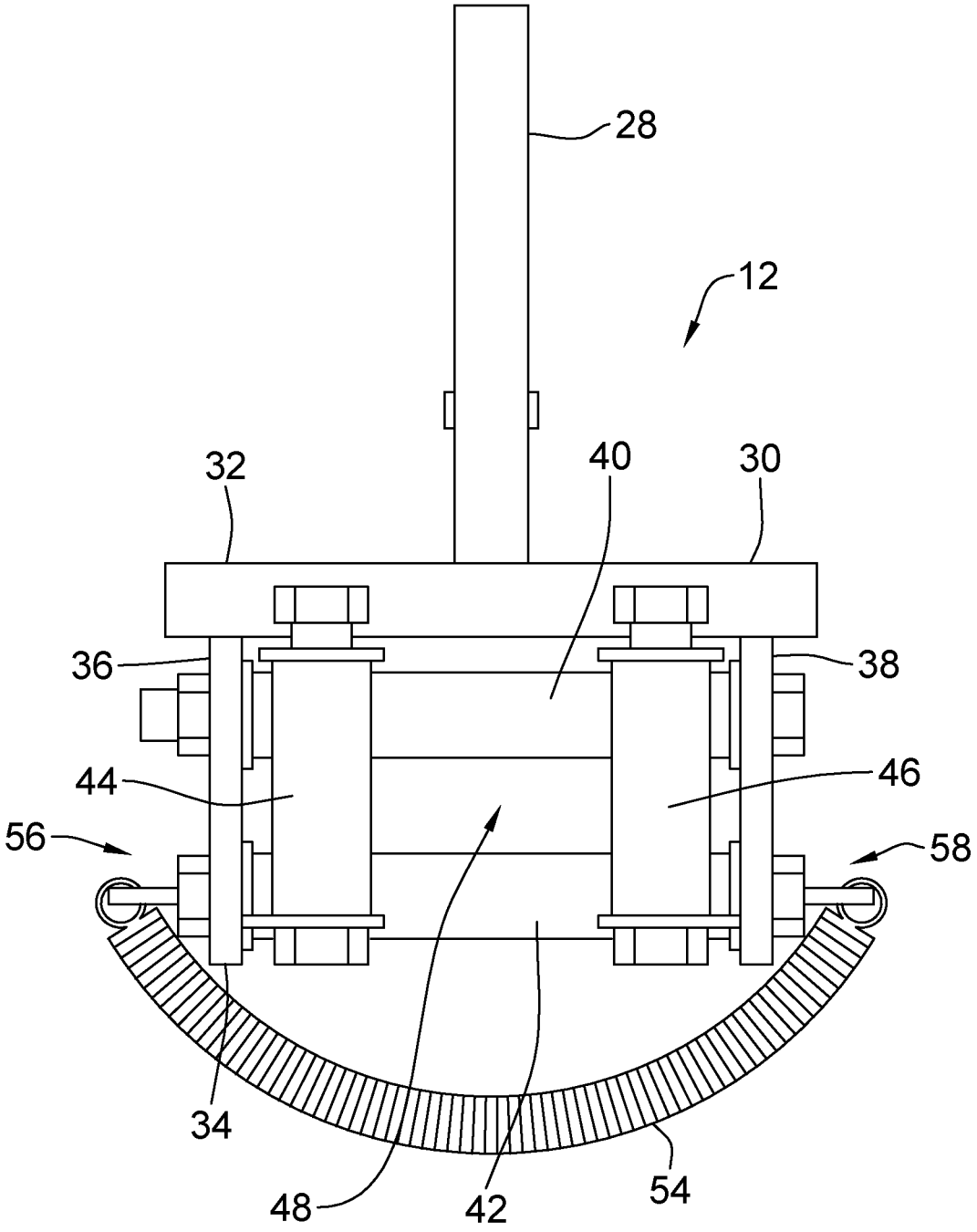
FIG. 2 is a front view of the apparatus of FIG. 1 in a bottom released position.

Turning now to FIGS. 1 and 2, the fairlead 30 extends between a top support 32 and a bottom edge 34, and between first and second side plates, 36 and 38, respectively. The fairlead 30 includes horizontal top and bottom rollers, 40 and 42, respectively, and vertical first and second side rollers, 44 and 46, respectively, defining an opening 48 therebetween. The opening 48 extends along an opening plane 50 which is parallel to and spaced apart from the pivot axis 22, as seen in FIGS. 1 and 4. The opening plane 50 extends along a tangent of the pivot radius 52 about the vertical pivot axis 22 as the head 12 is rotated about the pivot axis 22.

Figure 3:
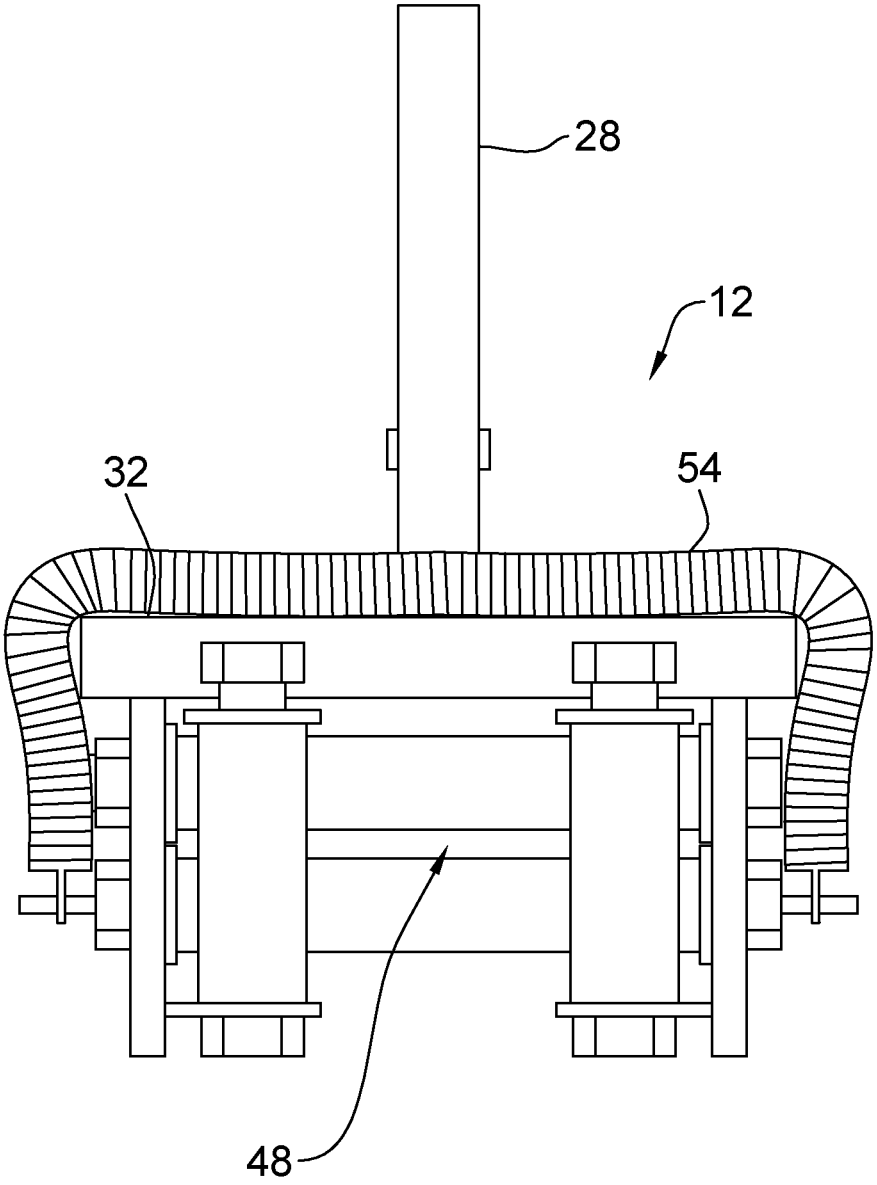
FIG. 3 is a front view of the apparatus of FIG. 1 in a top engaged position.

As best seen in FIG. 1, the bottom roller 42 is supported within vertical slots 52 extending through the first and second side plates, 36 and 38, respectively, of the fairlead 30. The bottom roller 42, extends between first and second ends, 56 and 58, respectively and is vertically translatable within the slots 52 between a bottom released position as illustrated in FIG. 2 and a top engaged position as illustrated in FIG. 3, such that the opening 48 may be reduced in size, the purpose of which will be set out below.

Figure 6:
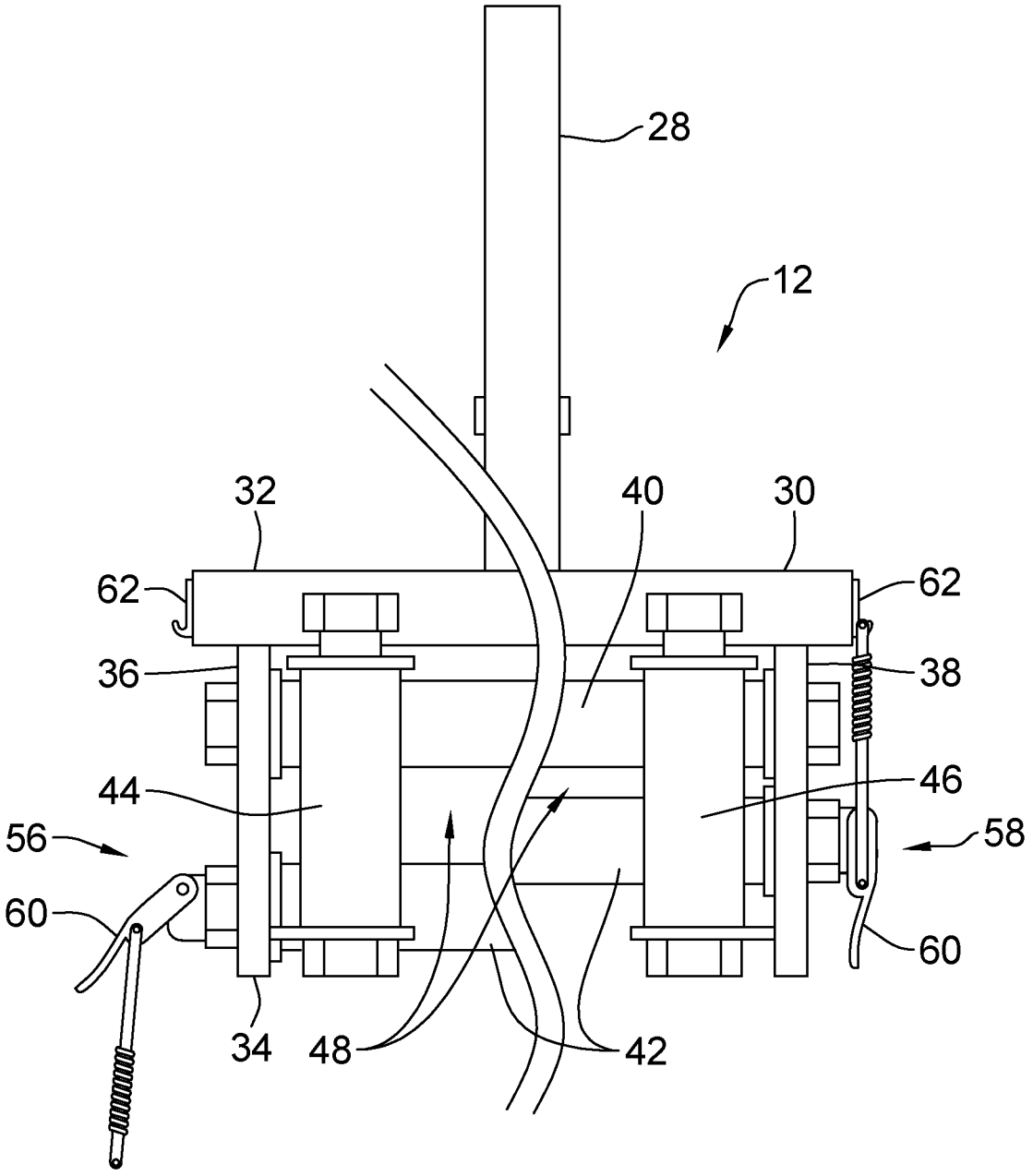
FIG. 6 is a further embodiment front view in both the bottom release position and the top engaged position.

A biasing spring 54 extends between the first and second ends 56 and 58 of the bottom roller 42. The biasing spring 54 is adapted to selectively bias the bottom roller 42 to a topmost engaged position, as illustrated in FIG. 3. The biasing spring 54 is extended over the top support 32 and the rigid elongate member 24, vertically translating the bottom roller 42 within the slots 52, and biasing the bottom roller 42 to the topmost engaged position. It will be appreciated that although the present embodiment of the invention illustrates one biasing spring 54, two biasing springs may be useful as well. In this embodiment, one spring is attached to each end, 56 and 58, of the bottom roller 42, each spring extending to the top roller 40 or to the top support 32, without extending horizontally across the head 12. As illustrated in FIG. 6, a further embodiment includes a pair of spring toggle latches 60, as is commonly known, secured to each end, 56 and 58, of the bottom roller 42. A pair of hooks 62, each operable to be engaged upon by the corresponding spring toggle latch 60, is secured to the top support 32 on each side, 56 and 58. When the spring toggle latch 60 is engaged upon the hook 62, the bottom roller 42 is raised to the second engaged position.

Figure 5:
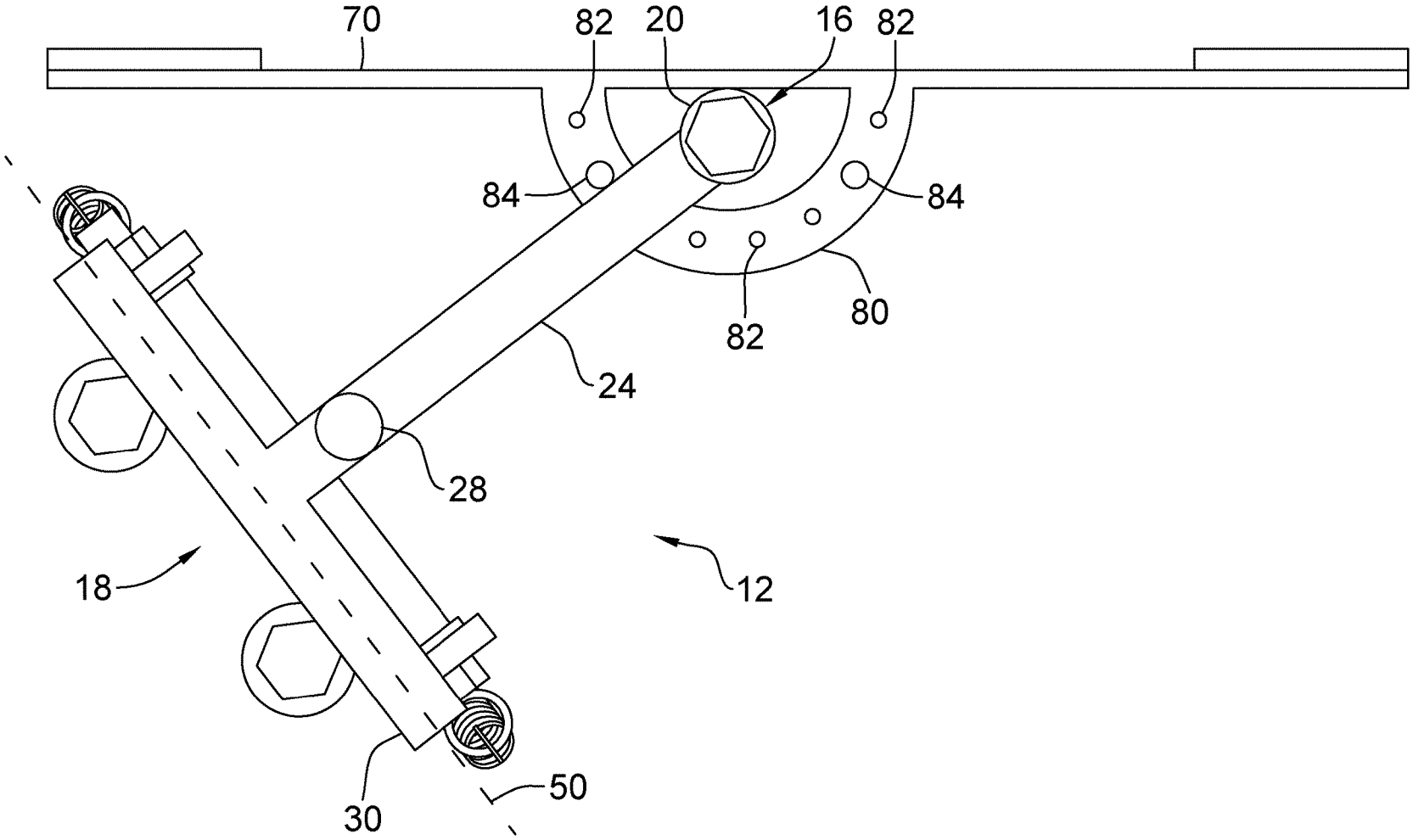
FIG. 5 is a further embodiment top view of the apparatus of FIG. 1.

As seen in FIG. 1, the bracket 70, is secured to the winch 4 by any known means, such as, by way of non-limiting example, welding or fasteners, such as bolts. The bracket 70 includes a first and second end stops, 72 and 74, respectively, extending perpendicularly therefrom, with a pivot support 72 centered therebetween. The position and size of the end stops 72 and 74 will be selected to limit the rotation of the head 12 so as ensure the flexible elongate tension member 8 is wound along the full length of the spool 6 and is not moved outside thereof. It will be appreciated therefore that the size and location of the end stops 72 and 74 will vary depending upon the winch model and size. As illustrated in FIG. 4 the end stops 72 and 74 may comprise rigid members extending from the bracket 70 to a distal end which is engageable upon the elongate rigid member 24. Optionally, as illustrated in FIG. 5, an arcuate plate 80 may extend from the bracket. The arcuate plate 80 may include a plurality of bores 82 therethrough adapted to receive a pin or bar 84. The pin will thereafter provide an end stop for the rotation of the head 12 and may be adjustable by locating the pins 84 in different bores 82.

As illustrated in FIG. 1, the bracket 70 supports a bottom receptacle 76 along the pivot axis 22. A bolt 78 is passed through the pivot tube 20 into engagement with the bottom receptacle so as to secure the pivot tube 20 along the pivot axis.

In operation, the spring 54 is initially in a relaxed position as illustrated in FIG. 2. In such position, the bottom roller 42 will be at a lowered position and the end of the cable 8 may be passed between the bottom and top rollers 42 and 40. Thereafter, the spring 54 is lifted over the top support 32 so as to bias the bottom roller 42 into engagement on the cable thereby clamping the cable 8 between the top and bottom rollers 40 and 42. Thereafter, the top and bottom rollers 40 and 42 will apply a tensioning force to the cable as it is wound in about the spool 6. During such winding, a user may grasp the handle 28 to rotate the head 12 back and forth to evenly distribute the cable on the spool.

While specific embodiments of the invention have been described and illustrated, such embodiments should be considered illustrative of the invention only and not as limiting the invention as construed in accordance with the accompanying claims.

What is claimed is:

1. An apparatus for guiding a flexible elongate tension member onto a spool, the apparatus comprising:

a pivot located in front of said spool extending along a vertical axis;

a head extending between proximate and distal ends wherein said proximate end is rotatably supported by said pivot along said vertical axis; and a fairlead located in said distal end of said head, said fairlead defining an opening for passing said flexible elongate tension member therethrough, said opening extending along a plane which is parallel to and spaced apart from said vertical axis, wherein said fairlead includes a bottom roller supported within slots in said head so as to be vertically translatable therein and a top roller thereabove and first and second side rollers defining said opening therebetween.

2. The apparatus of claim 1 wherein said plane of said opening extends along a tangent of a radius defined by rotating said head about said vertical axis.

3. The apparatus of claim 1 further comprising at least one biasing spring adapted to selectably bias said bottom roller to a topmost position within said slots.

4. The apparatus of claim 3 wherein said at least one biasing spring comprises one biasing spring.

5. The apparatus of claim 3 wherein said at least one biasing spring comprises two biasing springs.

6. The apparatus of claim 5 wherein said two biasing springs extend from first and second ends of said bottom roller so as to be extendable to and engageable with said head so as to bias said bottom roller to said topmost position within said slots.

7. The apparatus of claim 4 wherein said one biasing spring extends between first and second ends of said bottom roller so as to be extendable over said head so as to bias said bottom roller to said topmost position within said slots.

8. The apparatus of claim 1 further comprising a rear bracket supporting said pivot thereon.

9. The apparatus of claim 8 wherein said rear bracket is secured to a winch.

10. The apparatus of claim 8 wherein said rear bracket further includes first and second end stops extending therefrom positioned to engage upon said head at corresponding first and second side ends of rotation about said vertical axis.

11. The apparatus of claim 1 wherein said head further includes a handle extending therefrom for a user to rotate said head about said vertical axis.

12. The apparatus of claim 11 wherein said handle comprises a bar extending substantially parallel from said head.

13. A winch comprising:

a spool extending along a horizontal axis adapted to wind an elongate flexible tension member therearound;

a pivot located in front of said spool extending along a vertical axis;

a head extending between proximate and distal ends wherein said proximate end is rotatably supported by said pivot along said vertical axis; and a fairlead located in said distal end of said head, said fairlead defining an opening for passing said flexible elongate tension member therethrough, said opening extending along a plane which is parallel to and spaced apart from said axis, wherein said fairlead includes a bottom roller supported within slots in said head so as to be vertically translatable therein and a top roller thereabove and first and second side rollers defining said opening therebetween.

14. A method for winding a flexible elongate tension member about a spool of a winch, the method comprising:

providing a pivot in front of said spool extending along a vertical axis;

pivotally supporting a head extending between proximate and distal ends from said pivot, wherein said proximate end is rotatably supported by said pivot along said vertical axis;

passing the flexible elongate tension member through a fairlead located in said distal end of said head, said fairlead defining an opening for passing said flexible elongate tension member therethrough, said opening extending along a plane which is parallel to and spaced apart from said axis, wherein said fairlead includes a bottom roller supported within slots in said head so as to be vertically translatable therein and a top roller thereabove and first and second side rollers defining said opening therebetween; and moving said head side to side while rotating said spool so as to adjust the position of said flexible elongate tension member upon said spool.

* * * * *